US005090648A

United States Patent [19]

Wood, IV

[11] Patent Number: 5,090,648

[45] Date of Patent: Feb. 25, 1992

[54] STAND ASSEMBLY

[75] Inventor: William R. Wood, IV, Dennison, Tex.

[73] Assignee: TDS Manufacturing, Sherman, Tex.

[21] Appl. No.: 662,842

[22] Filed: Mar. 1, 1991

[51] Int. Cl.[5] ..... A47G 29/00

[52] U.S. Cl. ..... 248/125; 248/149; 248/161; 248/354.5; 269/208; 269/905

[58] Field of Search ..... 248/125, 149, 161, 157, 248/354.5; 118/500; 269/905, 208, 53, 542

[56] References Cited

U.S. PATENT DOCUMENTS 1,581,960 4/1926 King ..... 269/905 X
2,599,010 6/1952 Pernitz ..... 269/905 X
3,313,425 4/1967 Injeski ..... 248/125 X
3,355,136 11/1967 Staples ..... 248/354.5 X
3,643,935 2/1972 Bell ..... 269/905 X
4,141,192 2/1979 Augustine ..... 269/905 X

*Primary Examiner*—Ramon O. Ramirez
*Attorney, Agent, or Firm*—Jackson & Walker

[57] ABSTRACT

A stand assembly is provided for rotationally holding a door, window frame, or the like, for painting purposes. Pivot points are provided on the base and an extension contact with respective ends of the object to be held in the assembly. All surfaces of the object are exposed for painting when held and the object may be pivotally rotated during the painting. The assembly may be provided in a collapsible format.

6 Claims, 3 Drawing Sheets

STAND ASSEMBLY

BACKGROUND OF THE INVENTION (1) Field of the Invention

The invention relates to a stand assembly for rotationally holding an object to be painted, such as a door, window frame, or the like.

(2) Brief Description of the Prior Art

During the building, repair or renovation of a house, office building, or the like, doors, windows, and the like, often times must be painted on site. If they are first "hung" in place, and thereafter painted, many situations will cause the painting process to be delayed because of inaccessability of one or more surface areas of the door or window. Additionally, the permanent affixation of the door prior to painting often requires painting of just one side of the door prior to movement thereof before complete drying occurred. There is, therefore, need of a device upon which a door, window, or similar object may be placed for painting purposes prior to permanent affixation in the building for convenience of painting and which permits all surfaces of the object to be painted during one continuous procedure, and, further, which permits rotational movement of the object to be painted during the painting procedure.

Applicant is aware of the following prior art which is typical of prior art devices:

| U.S. PAT. NO.: | PATENTEE: |
|---|---|
| 684,097 | Quigley et al |
| 1,106,915 | Beasejour |
| 1,581,960 | King |
| 2,599,010 | Pernitz |
| 3,006,107 | Tolegian |
| 3,643,935 | Bell |
| 4,141,192 | Augustine |
| 4,278,244 | Carter |

All of these prior art devices are deficient in one way or another because they fail to expose all surface areas of the door or window to be painted, at one time, for complete painting without interruption of the painting cycle for movement of the device or object. Further, none of the devices permit complete exposure of the door or window to be painted and permit pivotal rotation of same during the painting cycle or operation.

The present invention addresses the deficiencies of the prior art as described above and therein.

SUMMARY OF THE INVENTION

The present invention provides a stand assembly for rotationally holding an object to be painted. The assembly comprises a base. A first pivot point projection means is defined on said base for pivotal receipt of one end of said object. An upright support extends from the base and has a plurality of selectively telescopically expandable and contractable members thereon. Locking means are provided for holding the members in a telescoped position. An elongate pivot support is provided perpendicularly extending from the upright support and above and in alignment with the securing projection. A second pivot point projection means is provided on the pivot point and is alignable with the first pivot point for pivotal receipt of the other end of the object, whereby upon receipt of the object within the stand and by the pivot points, all surfaces of the object are exposed for painting and the object may be pivotally rotated during painting.

DESCRIPTION OF THE PREFERRED EMBODIMENTS

Figure 1:
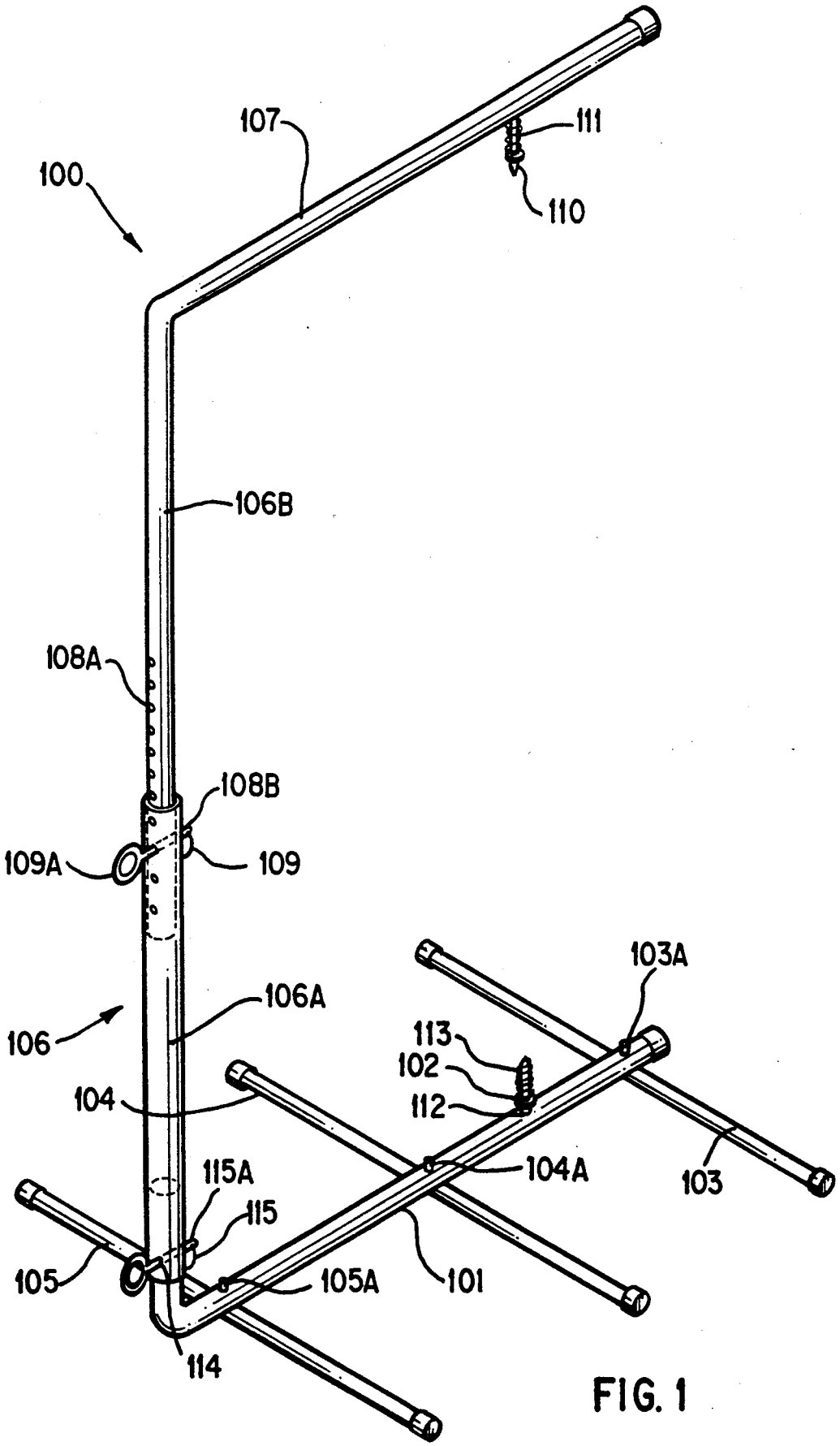
FIG. 1 is a view of the stand assembly of the present invention prior to receipt of the object to be painted.
Figure 2:
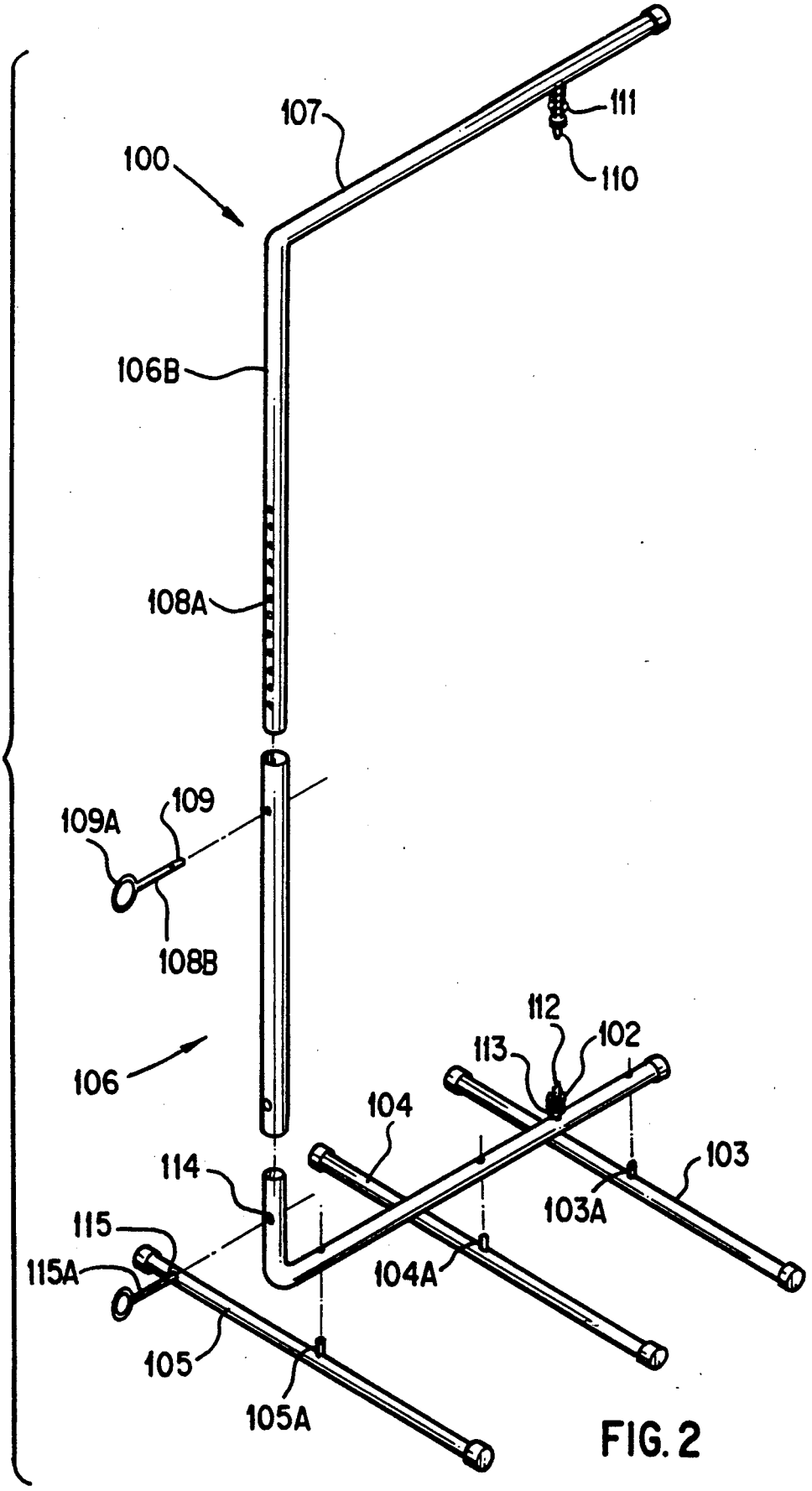
FIG. 2 is a view similar to FIG. 1 showing the component parts of the stand assembly separated and in alignment for assembly or disassembly.

Now with reference to FIG. 1, there is shown the stand assembly 100 of the present invention. The assembly 100 has a lower base 101 with three outwardly extending legs or crosses, i.e., an outer cross 103; a central cross 104; and an inner cross 105. The outer cross 103 is secured such as by welding, flanges, bolting, or the like at securement 103A to the base 101. The central cross 104 is likewise held to the base at securement 104A and the inner cross 105 is also secured to the base 101 in the same fashion at securement 105A.

An upright support 106 is carried by the base 101 and consists of first and second telescopically expandable selectively contractable members 106A, 106B. As shown, the second member 106B extends within the first member 106A, which is cylindrical in configuration. The second member 106B may, or may not, be cylindrical in nature, and may be a bar, or other solid object with no passageway extending therethrough. The second member has a series of spaced lock bores 108A extending therethrough in order to adjust the telescopic expansion or contraction of the member 106B relative to the member 106A. Likewise, the first member 106A has one or more lock bores 108B therein for receipt of a lock pin 109 which is introduced through the bores 108A, 108B by means of hand holding of the controller ring 109A.

A pivot support 107 is carried by the second member 106B and extends in alignment relative to the base 101. A pivot pin 110 is carried on the support 107 and extends downwardly therefrom toward the base 101. A biasing means, such as spring 111 is carried around the exterior of the pin 110 for frontal engagement with the support 107 to urge the pin 110 downwardly from the support 107.

In direct alignement with the pin 110 is a similar and companion pin 112 on a central rib 102 of the base 101 with a spring 113 carried thereon to urge the pin 112 upwardly and away from the rib 102.

Figure 3:
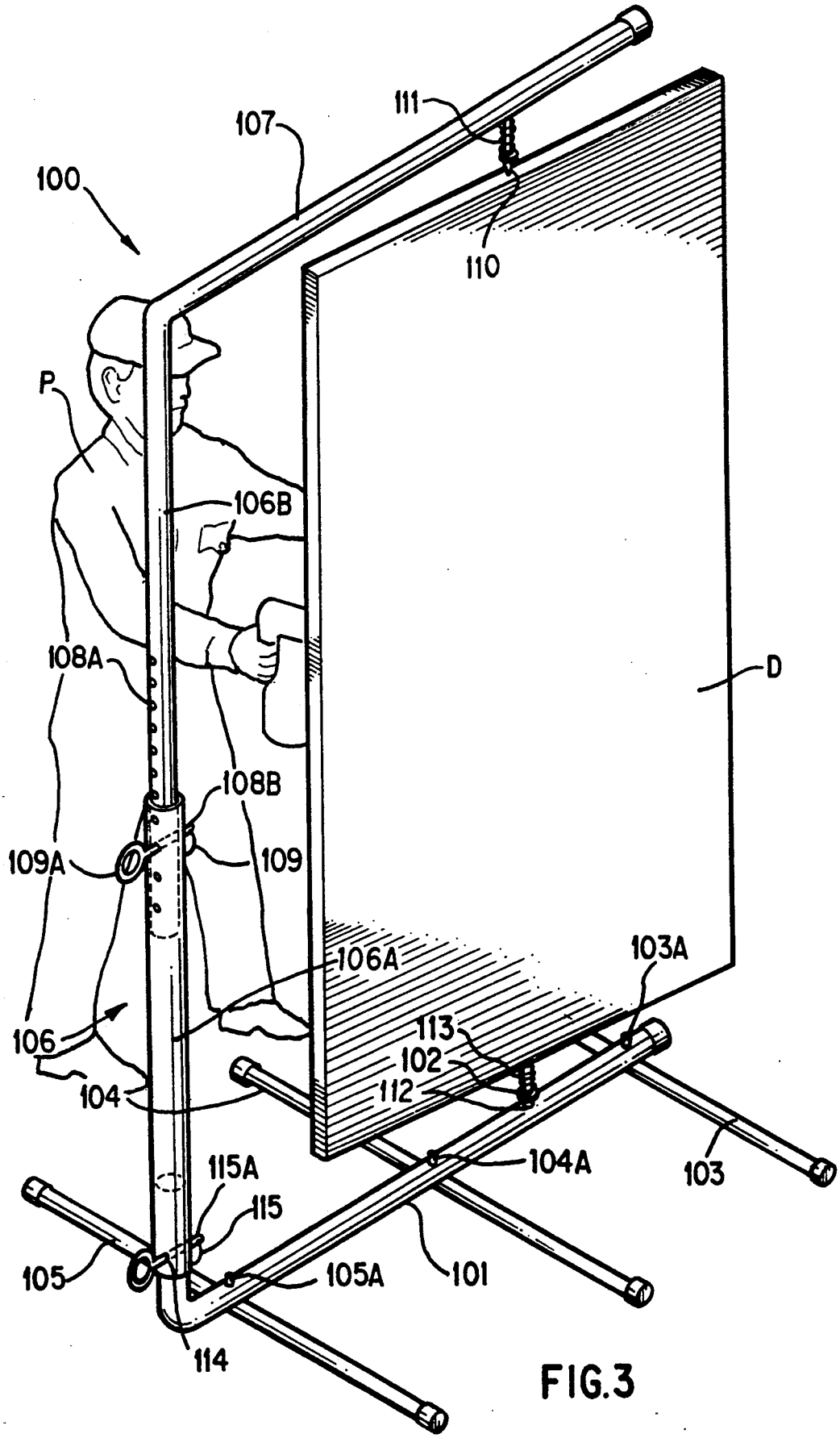
FIG. 3 is a view similar to those of FIGS. 1 and 2 showing the door in the assembly and being rotated during painting.

Now referring to FIG. 3, when it is desired to receive the door D for painting purposes, the painter P places same such that the pivot pin 112 encounters the lower face of the door D and the pivot pin 110 touches the upper face of the door. Accordingly, the door now is carried by the assembly 100 and the painter P may begin painting, such as by spray painting, by rotationally moving the door D around the assembly 100 and on the pins 110, 112. The door D may be removed from the assembly 100 and the upright support 106 members 106A, 106B may be selectively telescoped either expandedly or contractedly relative to one another by the painter P placing his hand on the controller 109A of the locking pin 109 and removing same from the selected bores 108A, 108B. Thereafter, the upper or second member 106B may be moved telescopically relative to the first member 106A, to either increase the distance between the pins 110, 112, or by decreasing the distance between such pins 110, 112, and the lock pin 109 being replaced in the selected bores 108A and through the bore 108B of the first member 106A.

A feature of the present invention is the collapsible nature of the assembly. Accordingly, a protrusion 114 is defined immediate the inner cross 105 on the rib 102 for snug insertion within the cylindrical first member 106A of the upright support 106. A locking pin 115 is held at its holder 115A by the painter P and inserted into securement to hold the upright support 106 relative to the base 101. Additionally, each of the crosses, 103, 104 and 105 may be disengaged from the rib 102 by unbolting same or by removing a pin between such members. Additionally, to provide further collapse of the assembly 100, the second member 106 may be completely removed from engagement with the first member 106A. Therefore, the assembly 100 is provided in four basic pieces. First, there is the rib 102. Next, each of the crosses, 103, 104 and 105 are disengagable from the rib 102. Finally, the first and second members 106A and 106B are disengagable from one another, as well as from the rib 101. Of course, the pivot support 107 may also be disengaged from the second member 106B and provided in a separate and independent component part and engagable relative to the second member 106B by providing two or more securement pins, bolts, or the like, which are affixed relative to the second member 106B at the uppermost end thereof.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A stand assembly for rotationally holding an object to be painted, comprising: a base; a first pivot point projection means on said base for pivotal receipt of one end of said object; an upright support extending from said base and having a plurality of selectively telescopically expandable and contractable members; locking means for holding said members in a telescoped position; an elongate pivot support perpendicularly extending from said upright support and above and in alignment with said securing projection; and a second pivot point projection means on said pivot support and alignable with said first pivot point for pivotal receipt of the other end of said object, whereby upon receipt of said object within said stand and by said pivot points, all surfaces of said object are exposed for painting and said object may be pivotally rotated during painting.

2. The assembly of claim 1 whereby each of said pivot point projection means include biasing means to urge said pivot point projection means to one another.

3. The assembly of claim 1 wherein said locking means comprises at least one locking pin and a plurality of pin housings extending through said each of said expandable and contractable members.

4. A collapsible stand assembly for rotationally holding an object to be painted, comprising: a base; a first pivot point projection means securable on said base for pivotal receipt of one end of said object; an upright support extendable from said base and having a plurality of selectively telescopically expandable and contractable members; locking means for holding said members in a telescoped position; an elongate pivot support perpendicularly extendable from said upright support and above and in alignment with said securing projection; a second pivot point projection means insertable on said pivot support and alignable with said first pivot point for pivotal receipt of the other end of said object, one of said members being a cylindrical member; and a protrusion extending from said base and into said cylindrical member for holding the expandable and contractable members thereon, whereby upon receipt of said object within said stand and by said pivot points, all said surfaces of said object are exposed for painting and said object may be pivotally rotated during painting.

5. The assembly of claim 4 whereby each of said pivot point projection means include biasing means to urge said pivot point projection means to one another.

6. The assembly of claim 4 wherein said locking means comprises at least one locking pin and a plurality of pin housings extending through said each of said expandable and contractable members.

* * * * *